United States Patent [19]

Juechter

[11] Patent Number: 4,586,290

[45] Date of Patent: May 6, 1986

[54] TELESCOPING WINDOW STABILIZING MECHANISM

[75] Inventor: Tadge J. Juechter, Stanford, Calif.

[73] Assignee: General Motors Corporation, Detroit, Mich.

[21] Appl. No.: 715,983

[22] Filed: Mar. 25, 1985

[51] Int. Cl.[4] ..... E05F 11/38

[52] U.S. Cl. ..... 49/348; 49/360; 49/375

[58] Field of Search ..... 49/348, 349, 350, 351, 49/352, 374, 375, 431, 433, 360, 361, 362, 363

[56] References Cited

U.S. PATENT DOCUMENTS

| | | | |
|---|---|---|---|
| 2,565,232 | 8/1951 | Hezler | 49/350 |
| 3,591,982 | 7/1971 | Nantau | 49/350 |
| 3,670,454 | 6/1972 | Gebhard et al. | 49/349 |
| 3,868,788 | 3/1975 | Podolan | 49/374 |
| 4,241,542 | 12/1980 | Podolan et al. | 49/375 |
| 4,246,726 | 1/1981 | Breaz et al. | 49/352 |
| 4,329,816 | 5/1982 | Koike | 49/351 |

FOREIGN PATENT DOCUMENTS

| | | | |
|---|---|---|---|
| 0057510 | 5/1981 | Japan | 49/352 |
| 2080411 | 2/1982 | United Kingdom | 49/348 |

*Primary Examiner*—William E. Lyddane
*Assistant Examiner*—Gerald A. Anderson
*Attorney, Agent, or Firm*—Charles E. Leahy

[57] ABSTRACT

A mechanism for stablizing the lateral position of a raised window in a vehicle door includes a guide track mounted vertically within the window storage cavity of the door and a stabilizer strut slidably interengaged with the stabilizer strut for vertical movement therealong. A slider channel is attached to the window and slidably interengaged for vertical movement along the stabilizer strut. The slidable interengagement between the slider channel and the stabilizer strut is characterized by tapered walls on the slider channel which provide a small area of frictional contact with the stabilizer strut during sliding movement until the slider channel reaches the fully raised position with respect to the stabilizer strut at which point the tapered walls on the stabilizer strut engage with the tapered walls of the slider channel to provide a full length interengagement therebetween which functions to substantially stabilize the glass laterally of the vehicle in the fully raised position.

3 Claims, 8 Drawing Figures

TELESCOPING WINDOW STABILIZING MECHANISM

The invention relates to a window stabilizing mechanism and more particularly provides a mechanism for stabilizing the lateral position of the window when in the raised position.

BACKGROUND OF THE INVENTION

It is known to provide a window regulating mechanism for moving a window between a raised position closing the window opening and a lowered position in which the window is stored in a storage cavity within the vehicle door. It is desirable to store the window as close as possible to the bottom of the storage cavity so that maximum utilization of the storage cavity may be had and accordingly the windowsill structure of the door may be at its relative lowest possible elevation.

In such vehicle window installations, particularly those which the door does not have a window frame surrounding the window opening, it is desirable to stabilize the window at its raised position so that the window will be pressed firmly inwardly against sealing strips carried by the vehicle body roof rail and the B pillar to prevent leakage of water into the body.

The present invention provides a telescoping stabilizer linkage which stabilizes the position of the window in the raised position and telescopically retracts as the window is stored so that the window may be lowered to a greater depth within the storage cavity.

SUMMARY OF THE INVENTION

According to the invention, mechanism for stabilizing the lateral position of a raised window in a vehicle door includes a guide track mounted vertically on the door within the window storage cavity thereof and having length less than the depth of the cavity with upper and lower ends spaced respectively from the top and bottom of the cavity. A stabilizer strut stands vertically along the guide track and has a central portion slidably interengaged with the stabilizer strut for vertical movement therealong between a lowered position in which the bottom of the stabilizer strut extends below the guide track and a raised position in which the top of the stabilizer strut extends above the guide track. A slider channel is attached to the window and slidably interengaged for vertical movement along the length of the stabilizer strut. The slidable interengagement between the slider channel and the stabilizer strut is characterized by tapered walls which provide a small area of frictional contact with the stabilizer strut during the sliding movement therebetween until the slider channel reaches the fully raised position with respect to the stabilizer strut at which point the tapered walls on the stabilizer strut engage with the tapered wall of the slider channel to provide a full length interengagement therebetween which functions to substantially stabilize the glass laterally of the vehicle in the fully raised position.

Thus, the object, feature and advantage of the present invention resides in a telescoping stabilizing mechanism acting between a window and a door mounted track and including a stabilizer strut which slidably interengages with both a door mounted guide track and a glass mounted slider channel, and which extends between a lowered position extending below the guide track and a raised position extending above the guide track.

A further object, feature and advantage of the invention resides in the provision of a telescoping stabilizer mechanism in which a stabilizer strut which slides along a door mounted guide track and has a slidable interfit with a glass mounted slider channel having tapered sliding contact surfaces adapted to cooperate with the facing contact surfaces of the stabilizer strut to provide a small area of frictional contact therebetween during the up and down sliding movement of the slider channel relative to the guide track and then provide a larger bearing area of contact therebetween when the slider channel reaches the fully raised position relative to the stabilizer strut to provide substantial lateral stabilizing interconnection between the slider and the stabilizer strut.

BRIEF DESCRIPTION OF THE DRAWINGS

These and other features, objects and advantages of the invention will become apparent upon consideration of the specification and the appended drawings in which.

DESCRIPTION OF THE PREFERRED EMBODIMENT

Figure 1:
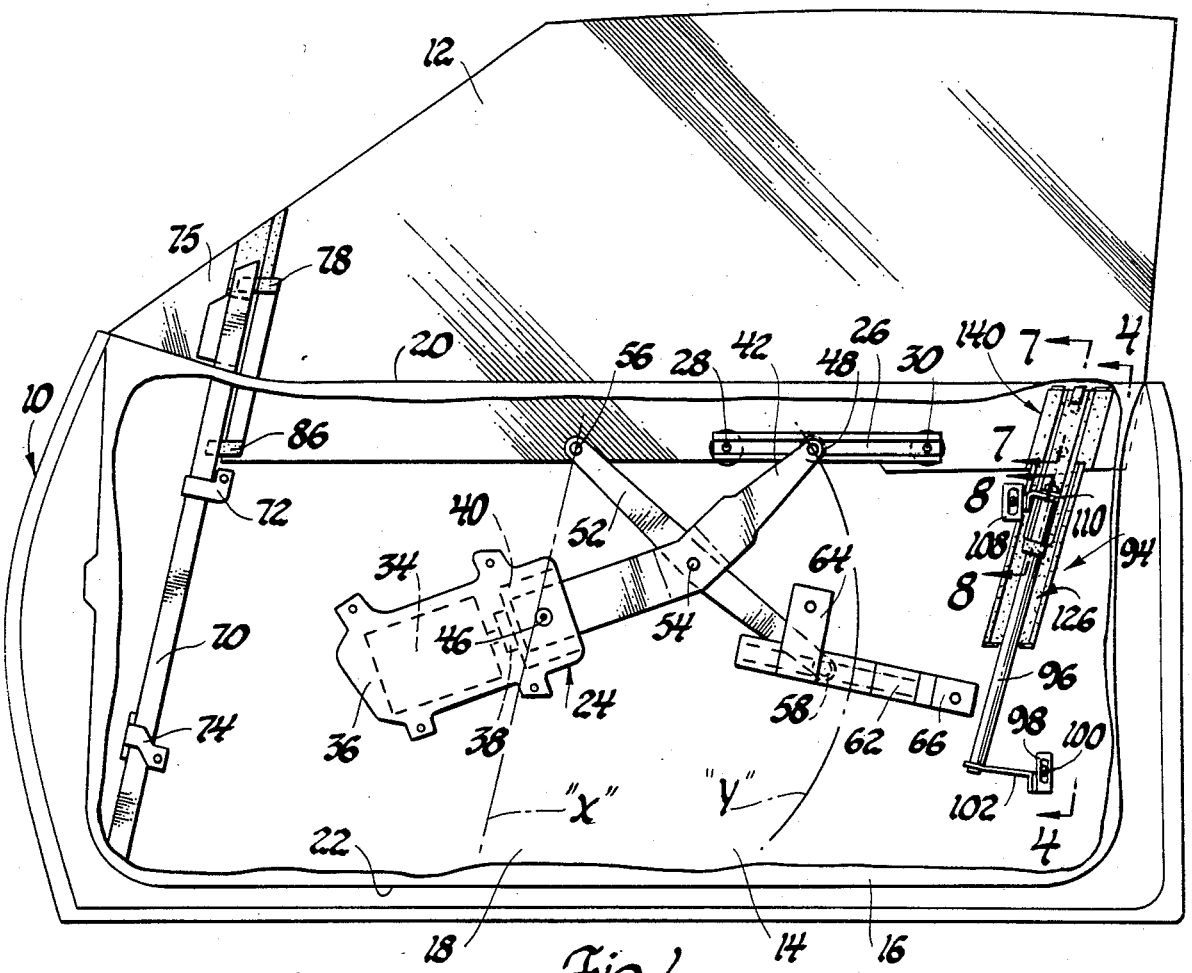
FIG. 1 is a partially broken-away side elevation view of a vehicle door embodying a telescoping window stabilizing mechanism according to the invention, the window being shown in the raised position.

Referring to FIG. 1, a vehicle door 10 of a vehicle body is adapted for conventional hinging to the hinge pillar of the vehicle body for swinging movement between an open position and a closed position. When the door is in the closed position, a portion of the door opening is closed by a window 12 mounted on the door 10.

As best seen in FIG. 1, the door 10 includes an outer panel 14 and an inner panel 16 which are spaced apart to define a storage cavity 18 in which the window 12 is stored. The height of the window 12 is only slightly less than the dimension between the sill 20 of the door 10 and the bottom wall 22 of the storage cavity 18.

Figure 2:
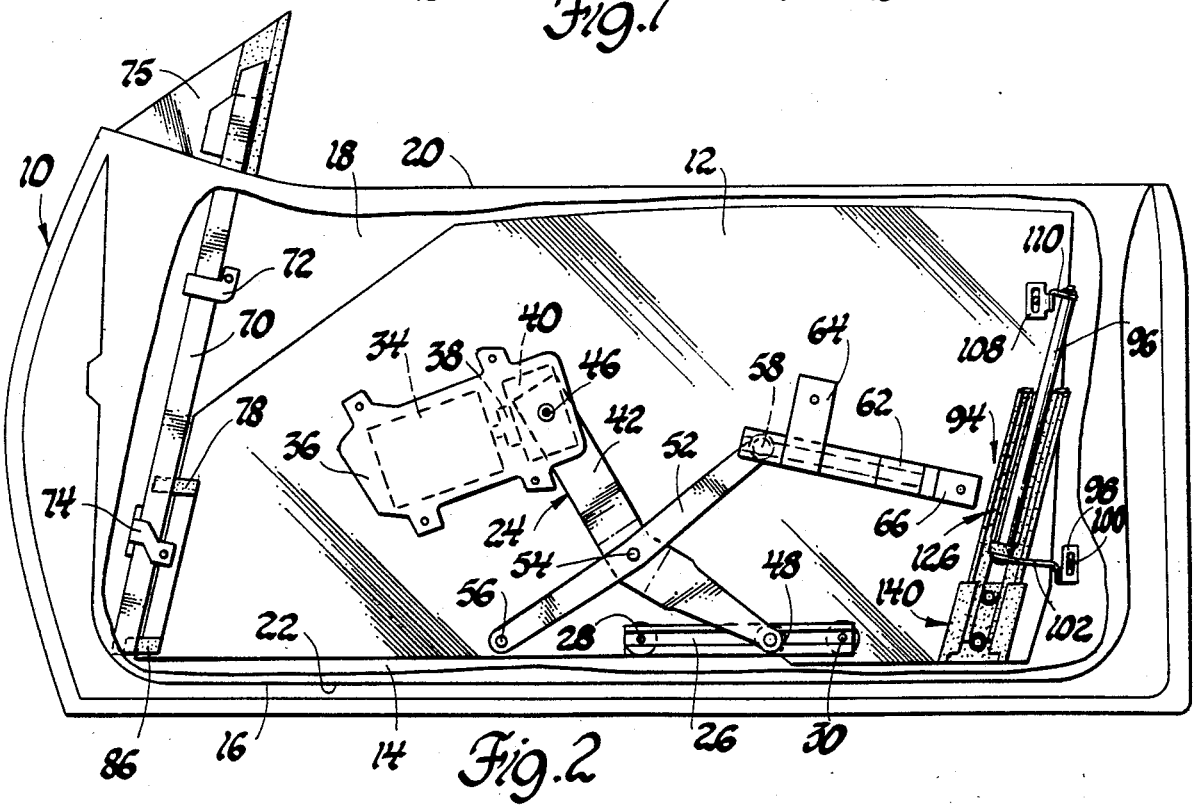
FIG. 2 is a view similar to FIG. 1 but showing the window in the lowered position.

A window regulator mechanism, generally indicated at 24, is provided for moving the window 12 between a raised closed position shown in FIG. 1 and a lowered open position shown in FIG. 2. The window regulator mechanism 24 includes a C-shaped sash channel 26 which is mounted along the lower edge of the window 12 by bolts 28 and 30. A motor 34 is mounted on a mounting bracket 36 attached to door inner panel 16 and has a pinion gear 38 which meshes with a gear sector 40 of a regulator arm 42. The regulator arm 42 is mounted on the mounting bracket 36 by a pivot 46. A roller 48 is pivotally mounted on the end of the regulator arm 42 and rides in the sash channel 26.

The window regulator mechanism 24 also includes a guide arm 52 which is mounted on the regulator arm 42 by pivot 54. One end of the guide arm 52 is fixedly attached to the window 12 by bolt 56. The other end of the guide arm 52 carries a roller 58 which rides in a guide channel 62 mounted on the door inner panel 16 by brackets 64 and 66.

The window is lowered from the raised position of FIG. 1 by energizing the electric motor 34 to pivot the regulator arm 42 downwardly. The roller 48 carried on the end of the regulator arm 42 descends along the arcuate path "Y" and lowers the rear end of the window 12. Concommitantly, the guide arm 52 carried on the regulator arm 42 by pivot 54 moves downwardly with its one end carrying roller 58 guided in the guide channel 62 so that the other end fixedly attached to window 12 by bolt 56 descends along the straight line designated "X" to support and control the downward movement of the front end of the window 12.

As best seen in FIGS. 1 and 2, the front end of the window 12 is supported and guided by a channel 70 which extends from the bottom wall 22 of the storage cavity 18 to a height above the door sill 20. The channel 70 is mounted upon the door inner panel 16 by mounting brackets 72 and 74. A triangular patch 75 of window glass is fixedly mounted on the door adjacent to upper end of the channel 70. A plastic upper foot 78 is bonded to the upper leading edge of the window 12 and extends into the channel 70. A similar lower foot 86 is attached to the lower front corner of the window 12 and also slides in the channel 70.

As the window 12 moves between the raised position of FIG. 1 and the lowered position of FIG. 2, the upper foot 78 and lower foot 86 slide within the channel 70 to establish the lateral location of the forward end of the window 12.

Figure 4:
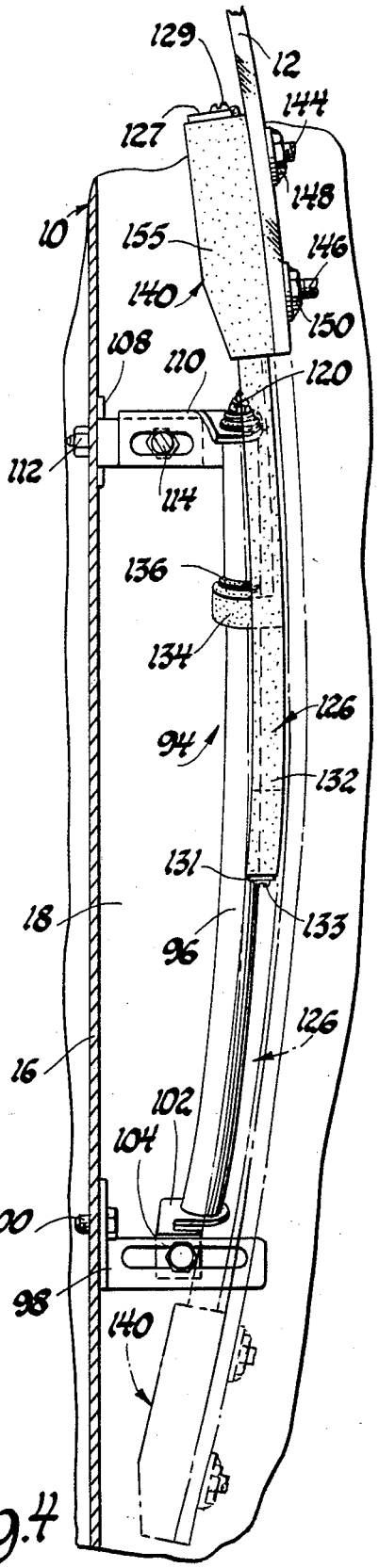
FIG. 4 is a sectional view taken in the direction of arrows 4—4 of FIG. 1 and showing the raised position in solid lines and the lowered position in phantom lines.

A telescoping stabilizer mechanism, generally indicated at 94, is provided to stabilize the lateral position of the rear end of the window 12. As best seen in FIGS. 1 and 4, the stabilizer mechanism 94 includes a curved tubular guide track 96 which is curved to match the curvature of the window 12. The lower end of the tubular guide track 96 is mounted on the door inner panel 16 by a bolt 104 attaching a first mounting bracket 98 attached to the inner panel 16 by bolt 100 with a second mounting bracket 102 which is welded or otherwise suitably attached to the lower end of the tubular guide track 96. The bolts 100 and 104 ride in slots which permit vertical and lateral adjustment of the tubular guide track 96. The upper end of the tubular guide track 96 is similarly mounted on the door inner panel 16 by mounting brackets 108 and 110 and cooperating bolts 112 and 114. The upper end of the tubular guide track 96 is attached to the mounting bracket 110 by a threaded plug 118 and nut 120. The tubular guide track 96 has a height less than the depth of the storage cavity 18 and is generally vertically centered in the door cavity so that the upper end is below the windowsill 20 and the lower end is above the bottom wall 22 of storage cavity 18.

Figure 6:
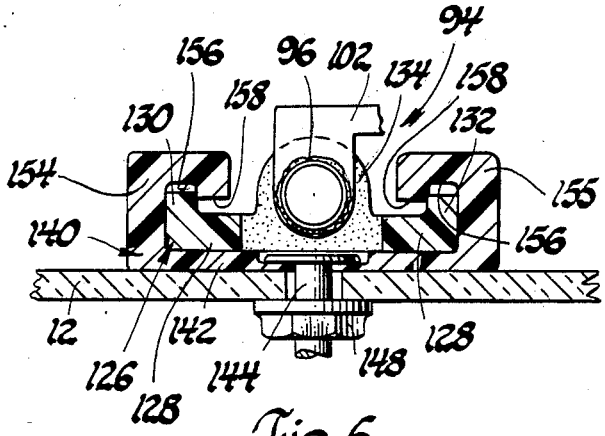
FIG. 6 is a sectional view taken in the direction of arrows 6—6 of FIG. 3.

A molded plastic stabilizer strut 126 is slidably interengaged with the tubular guide tube 96. As best seen in FIG. 6, the stabilizer strut 126 includes a generally planar rectangular base portion 128 which has a curvature to match the curvature of the window 12 and the tubular guide track 96. Ribs 130 and 132 project from the base 128 inwardly toward the center of the vehicle all along the length thereof. Stabilizer strut 126 also has an integrally molded ring 134 about mid-length thereon which encircles the tubular guide track 96 and receives a teflon bushing 136. The stabilizer strut 126 is approximately the same length as the tubular guide track 96. A stopper plate 127 is mounted on the top of the stabilizer strut 126 by screw 129. A stopper plate 131 is mounted on the bottom of the stabilizer strut by screw 133.

Figure 3:
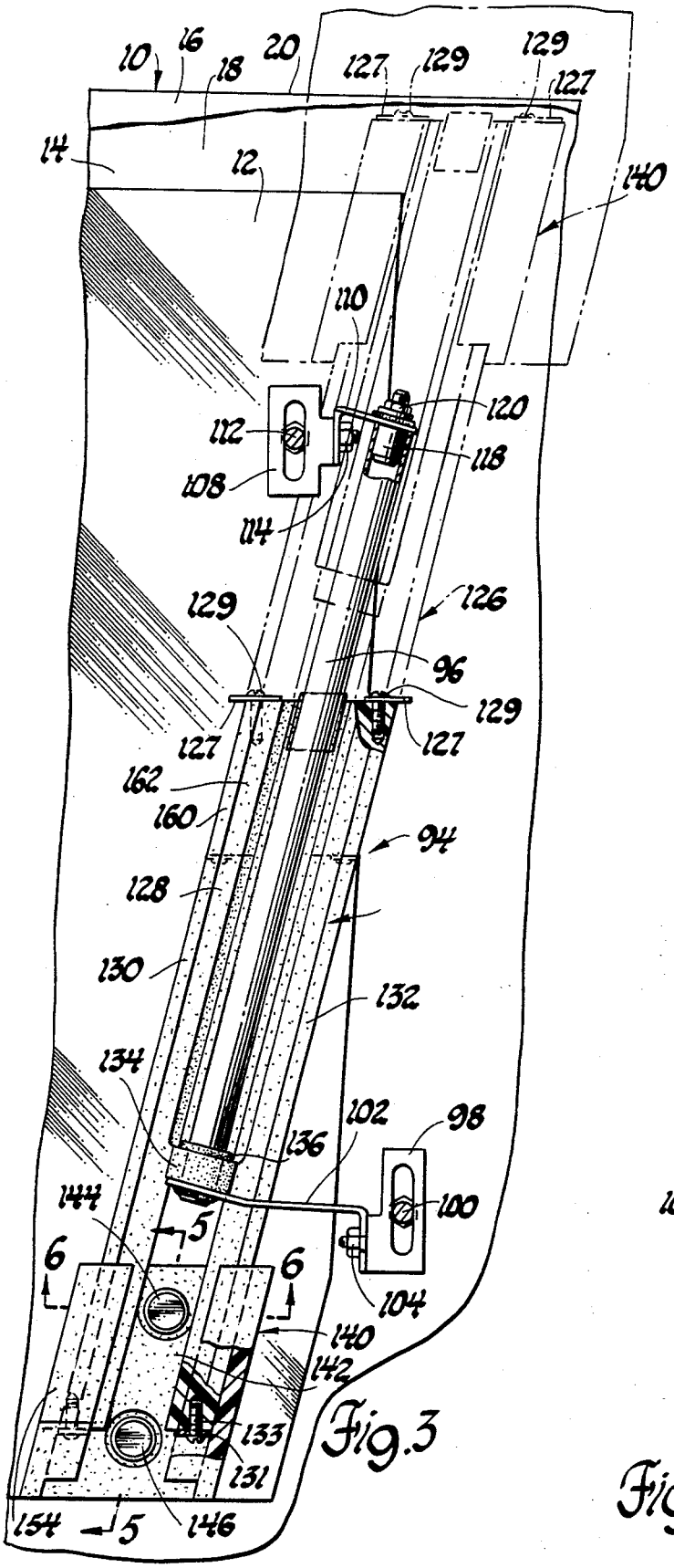
FIG. 3 is an enlarged fragmentary view similar to FIG. 2 showing the lowered position indicated by solid lines and the raised position indicated by phantom lines.
Figure 5:
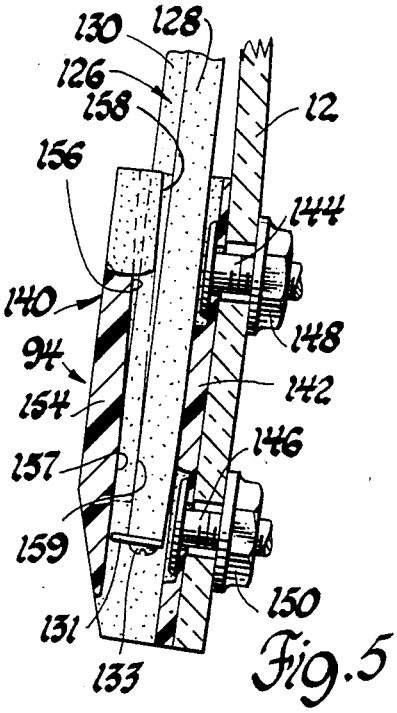
FIG. 5 is a sectional view taken in the direction of arrows 5—5 of FIG. 3.

As best seen in FIGS. 3, 5 and 6, a molded plastic slider channel 140 is attached to the window 12 and slidably interengaged with the stabilizer strut 126 for vertical sliding movement therealong between the stopper plates 127 and 131. The slider channel 140 includes a base wall 142 which is attached to the window 12 by an upper bolt 144 and a lower bolt 146 which respectively receives nuts 148 and 150. Slider channel 140 also has C-shaped edge walls 154 and 155 which surround the ribs 130 and 132 of the stabilizer strut 126 to provide a slidable interconnection therebetween. The C-shaped edge wall 154 includes a tapered wall 156 facing toward the rib 130 and a tapered wall 158 which faces toward the base 128. As best seen by reference to FIG. 5, the taper of the tapered walls 156 and 158 is such that only the lowermost portions of these walls defines lands 157 and 159 which engage with the facing walls of the stabilizer strut 126 while the greater length of these tapered walls is spaced away therefrom so that there is only a small area of contact therebetween adding friction into the system.

Figure 7:
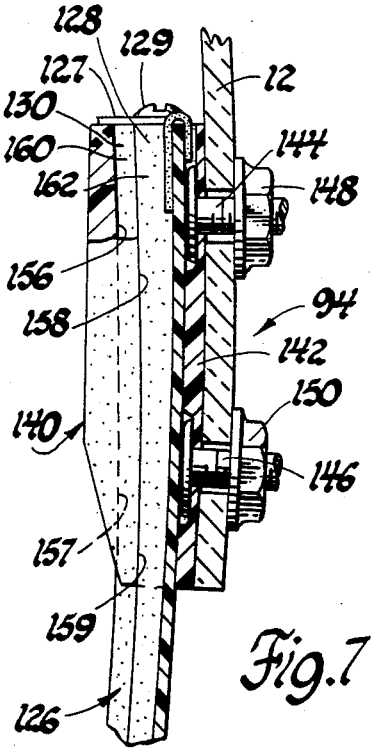
FIG. 7 is a view taken in the direction of arrows 7—7 of FIG. 1 and showing the interfit between the slider and the stabilizer in the fully raised position.
Figure 8:
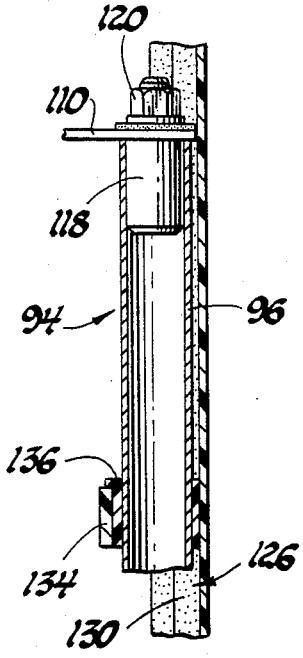
FIG. 8 is a sectional view taken in the direction of arrows 8—8 of FIG. 1.

As best seen in FIG. 7, the uppermost end portion 160 of the rib 130 of the stabilizer strut 126 is tapered inwardly toward the center of the vehicle at an angle which matches the taper of the tapered wall 156 of the slider channel 140. Likewise, the uppermost end portion of the base 128 of stabilizer strut 126 juxtaposed with the tapered wall 158 is tapered inwardly at an angle which matches the taper of the tapered wall 158. Accordingly, as best seen in FIG. 7, when the slider channel 140 is fully raised relative to the stabilizer strut 126, the tapered wall 156 engages along its full length with the uppermost end portion 160 of the stabilizer strut rib 130. Simultaneously, the tapered wall 158 engages along its full length with the uppermost end portion 162 of the stabilizer strut base 128. The C-shaped edge wall 155 of the slider channel 140 and the base 128 and rib 132 have similar cooperating tapers which are identified by like numerals.

OPERATION

The window 12 is moved from the open position of FIG. 2 to the closed position of FIG. 1 by energizing the motor 34 of the window regulator 24. The regulator arm 42 is thus raised and the guide arm 52 cooperates therewith to raise the window 12 therewith as described hereinbefore.

The slider channel 140 is raised with the window 12 from its lowermost position of FIG. 3 to the fully raised position of FIG. 4. During such movement, the slider channel 140 slides upwardly along the stabilizer strut 126 and then the stabilizer strut 126 slides upwardly along the tubular guide track 96. In some cases, depending on the friction between the parts, the stabilizer strut 126 will move first along the tubular guide track 96 and then the slider channel 140 will slide upwardly along the stabilizer strut 126. The friction between the slider channel 140 and the stabilizer strut 126 is minimized by having the small area of contact at the bottom only of the tapered walls 156 and 158 of the slider channel 140. The friction between the stabilizer strut 126 and the tubular guide track 96 is minimized by the teflon bushing 136.

When the window 12 reaches the fully raised position of FIGS. 1, 4 and 7, the slider channel 140 engages with the stopper plate 127 of the stabilizer strut 126 and the tapered walls 156 and 158 of the slider channel 140 engage with the stabilizer strut 126 to provide a substantial length of contact therebetween which is effective to stabilize the glass 12 against lateral movement relative to the stabilizer strut 126. Accordingly, the glass 12 is stabilized and is forced laterally of the body into engagement with a weather strip surrounding the door opening.

Thus, it is seen that the invention provides a new and improved telescoping stabilizer mechanism for a vehicle window. The telescoping stabilizer mechanism stabilizes the lateral position of the glass in the door at the raised position thereof. The telescoping stabilizer mechanism has raised and lowered positions in which the stabilizer strut 126 and the slider channel 140 extend respectively higher and lower than the tubular guide track 96 so that the door need not be as wide at the top and bottom as would be required to receive the tubular guide track 96 in addition to the stabilizer strut 126 and the slider channel 140.

The embodiments of the invention in which an exclusive property or privilege is claimed are defined as follows:

1. In a vehicle body door having a window opening and a window storage cavity beneath the window opening, a window movable between a raised position closing the opening and a lowered position stored in the storage cavity, and window regulator means connected to the window for moving the window along a defined path of movement between the raised and lowered positions, a telescoping stabilizing mechanism comprising:

a guide track mounted on the door within the storage cavity;

a stabilizer strut slidably interengaged with the guide track for vertical movement therealong between a lowered position in which the bottom of the stabilizer strut extends below the guide track and a raised position in which the top of the stabilizer strut extends above the guide track;

a slider channel attached to the window and slidably interengaged with the stabilizer strut for vertical movement therealong between the top of stabilizer strut when the window is fully raised and the bottom of the stabilizer strut when the window is fully lowered; and said sliding interfit between the slider channel and the stabilizer strut being characterized by tapered walls provided respectively thereon and facing toward one another, said tapered walls cooperating to provide a small area of frictional contact therebetween during vertical movement of the window and the slider channel with respect to the stabilizer strut and coming into full length large area contact therebetween when the window and slider reach the fully raised position to provide a substantial bearing length between the slider channel and the stabilizer strut to substantially stabilize the glass laterally of the vehicle.

2. In a vehicle body door having a window opening and a window storage cavity beneath the window opening, a window movable between a raised position closing the opening and a lowered position stored in the storage cavity, and window regulator means connected to the window for moving the window along a defined path of movement between the raised and lowered positions, a telescoping stabilizing mechanism comprising:

a guide track mounted vertically on the door within the storage cavity, said guide track having a length less than the depth of the window storage cavity within the door and having a lower end spaced above the bottom of the cavity and an upper end spaced below the top of the cavity;

a stabilizer strut slidably interengaged with the guide track for vertical movement therealong between a lowered position in which the bottom of the stabilizer strut extends below the lower end of the guide track and a raised position in which the top of the stabilizer strut extends above the upper end of the guide track;

a slider channel attached to the window and slidably interengaged with the stabilizer strut for vertical movement therealong between the top of the stabilizer strut when the window is fully raised and the bottom of the stabilizer strut when the window is fully lowered;

said slidable interengagement between the slider channel and the stabilizer strut being provided at least in part by a tapered wall structure carried by the slider bracket and having a lowermost end portion thereof slidably interengaging with the stabilizer strut to provide a small length of frictional contact therebetween during vertical movement of the window and slider channel with respect to the stabilizer strut; and said stabilizer strut having a tapered wall structure at the upper end thereof adapted to engage the tapered wall structure carried by the slider channel when the slider channel reaches the fully raised position with respect to the stabilizer strut to thereby provide a greater length of contact between the stabilizer strut and the slider channel to substantially stabilize the lateral position of the raised window.

3. In a vehicle body door having a window opening and a window storage cavity beneath the window opening, a window movable between a raised position closing the opening and a lowered position stored in the storage cavity, and window regulator means connected to the window for moving the window along a defined path of movement between the raised and lowered positions, a telescoping stabilizing mechanism comprising:

a tubular guide track mounted vertically on the door within the storage cavity, said tubular guide track having a length less than the depth of the storage cavity and a lower end spaced above the bottom of the cavity and a top end spaced below the top of the cavity;

a molded plastic stabilizer strut of generally the same length as the tubular guide track and having an integral ring portion mid-length thereof encircling the tubular guide track for vertical movement therealong between a lowered position in which the bottom of the stabilizer strut extends below the tubular guide track and a raised position in which the top of the stabilizer strut extends above the tubular guide track;

a slider channel attached to the window and slidably interengaged with the stabilizer strut for vertical movement therealong between the top of stabilizer strut when the window is fully raised and the bottom of the stabilizer strut when the window is fully lowered; and said interengagement between the slider channel and the stabilizer strut being characterized by tapered walls provided respectively thereon and facing toward one another, said tapered walls cooperating to provide a small area of frictional contact therebetween during vertical movement of the window and the slider channel with respect to the stabilizer strut and coming into full length contact therebetween when the window and slider reach the fully raised position to provide a substantial bearing length between the slider channel and the stabilizer strut to substantially stabilize the glass laterally of the vehicle.

* * * * *